US005765718A

United States Patent [19]

Grasso et al.

[11] Patent Number: 5,765,718

[45] Date of Patent: Jun. 16, 1998

[54] CENTER PULL SHEET DISPENSING APPARATUS

[75] Inventors: Kamala J. Grasso, Wayland; Robert D. Schaefer, Wakefield, both of Mass.; John R. Moody, Antioch, Calif.

[73] Assignee: Fort James Corporation, Richmond, Va.

[21] Appl. No.: 908,538

[22] Filed: Aug. 7, 1997

Related U.S. Application Data

[63] Continuation of Ser. No. 732,014, Oct. 16, 1996, abandoned.

[51] Int. Cl.[6] ..... B65H 1/00

[52] U.S. Cl. ..... 221/62; 221/63; 221/1; 242/593; 242/615.3

[58] Field of Search ..... 242/593, 615.3; 221/1, 62, 63; 225/106

[56] References Cited

U.S. PATENT DOCUMENTS

| | | | |
|---|---|---|---|
| 4,846,415 | 7/1989 | Jernberg et al. | 225/106 |
| 5,211,308 | 5/1993 | Decker et al. | 221/63 |
| 5,246,137 | 9/1993 | Schutz et al. | 221/63 |
| 5,370,338 | 12/1994 | Lewis | 242/593 |
| 5,577,634 | 11/1996 | Morand | 221/63 |

FOREIGN PATENT DOCUMENTS 0740921 11/1996 European Pat. Off. .

*Primary Examiner*—H. Grant Skaggs

[57] ABSTRACT

A center pull towel dispenser includes two housing members which pivot about a vertical pivot axis. A support plate supports the coreless roll product on end with the lead end of the coreless roll product passing through a bottom wall disposed under the support plate. Various structural elements of the apparatus cooperate to provide ease of threading of a roll product lead end into a dispensing member including a downwardly converging, generally cone-shaped wall and to resist inadvertent pinching of the sheet product to be dispensed when the housing members form a closed interior.

26 Claims, 5 Drawing Sheets

CENTER PULL SHEET DISPENSING APPARATUS

This application is a continuation of application Ser. No. 08/732,014 filed Oct. 16, 1996, now abandoned.

TECHNICAL FIELD

This invention relates to the dispensing of sheet material, and more particularly, to apparatus for dispensing individual sheets, such as paper towels, from the center of a coreless roll comprised of a plurality of the sheets.

BACKGROUND OF THE INVENTION

A number of dispensers exist in the prior art for dispensing paper toweling and the like. Some of these dispensers are of the "center pull" type wherein a web of toweling or other sheet material is pulled from the center of a coreless roll through a nozzle or other sheet restricting element forming a restricted passageway. Assuming that the individual sheets of toweling or other material are connected by perforated lines, as is common, the nozzle or other restricting element will resist pulling of the sheet material by the user, thus breaking an individual sheet from the remaining web along the perforated line interconnecting same.

It is quite common to utilize center pull nozzles which have a cone-like on funnel-shaped wall configuration. In such arrangements, the nozzle has a towel lead end entrance hole which is relatively large in comparison with the exit hole thereof. The entrance opening and the exit opening are dimensioned such that a first paper towel will separate from a following paper towel along the perforation boundary therebetween when a leading portion or end of the following paper towel exits from the exit opening.

Some problems have been encountered with center pull dispensers of the general type just described. For example, such dispensers incorporating funnels or nozzles with continuous peripheral walls present difficulties with regard to the initial threading of the toweling or other sheet material lead end due to the generally constricted nature of the passageway through which the lead end must progress and exit therefrom to a position where the lead end may be manually grasped by a consumer. Furthermore, attendants servicing the dispenser are presented with the additional problem of covers or housing members which must be moved up or down to allow access to the interior of the dispenser. This is not only awkward but can result in injury occasioned by the cover falling under the influence of gravity and striking the attendant. Then too, inadvertent pinching of the toweling or other sheet material can occur in prior art devices when the housing member or covers are closed. This can result in sheet material tearing or other problems insofar as proper operation of the dispenser is concerned.

DISCLOSURE OF INVENTION

This invention relates to a center pull dispenser for paper towels and other sheet material which is characterized by its simplicity and relatively low cost. Furthermore, the apparatus incorporates structure which facilitates feeding of the lead end of a roll product to be dispensed and also incorporates a cover structure which is mounted so that it is not a hazard to an individual servicing the dispenser apparatus. Cooperation of structural elements of the apparatus is such that inadvertent pinching or snagging of the product to be dispensed is considerably lessened as compared to prior art arrangements.

The apparatus disclosed and claimed herein is for dispensing individual sheets from the center of a coreless roll product comprised of a plurality of said sheets forming a wound web having a lead end projecting outwardly from the center.

The apparatus includes a first housing member and a second housing member. The second housing member is pivotally mounted on the first housing member about a substantially vertical pivot axis. The second housing member is substantially horizontally movable between a closed position wherein the first and second housing members define a substantially closed housing interior and an open position.

A roll product support plate is attached to the first housing member for supporting a coreless roll product on end and defines a support plate opening.

A dispensing member projects downwardly from the roll product support plate and includes a downwardly converging, generally cone-shaped wall defining a passageway communicating with the support plate opening and leading from the support plate opening to a restricted outlet opening. The downwardly converging, generally cone-shaped wall and the support plate define an elongated slot extending between the support plate opening and the restricted outlet opening. The support plate opening and the passageway are for accommodating the lead end projecting downwardly from the center of a coreless roll product supported on end by the support plate. The slot is for the purpose of facilitating insertion of the lead end into the passageway.

The apparatus additionally includes an elongated rib member connected to the second housing member. The elongated rib member is positioned in the slot and located between the support plate opening and the restricted outlet opening when the second housing member is in the closed position and the elongated rib member is withdrawn from the slot when the second housing member is in the open position. other features, advantages, and objects of the present invention will become apparent with reference to the following description and accompanying drawings.

BEST MODE FOR CARRYING OUT THE INVENTION

Figure 1:
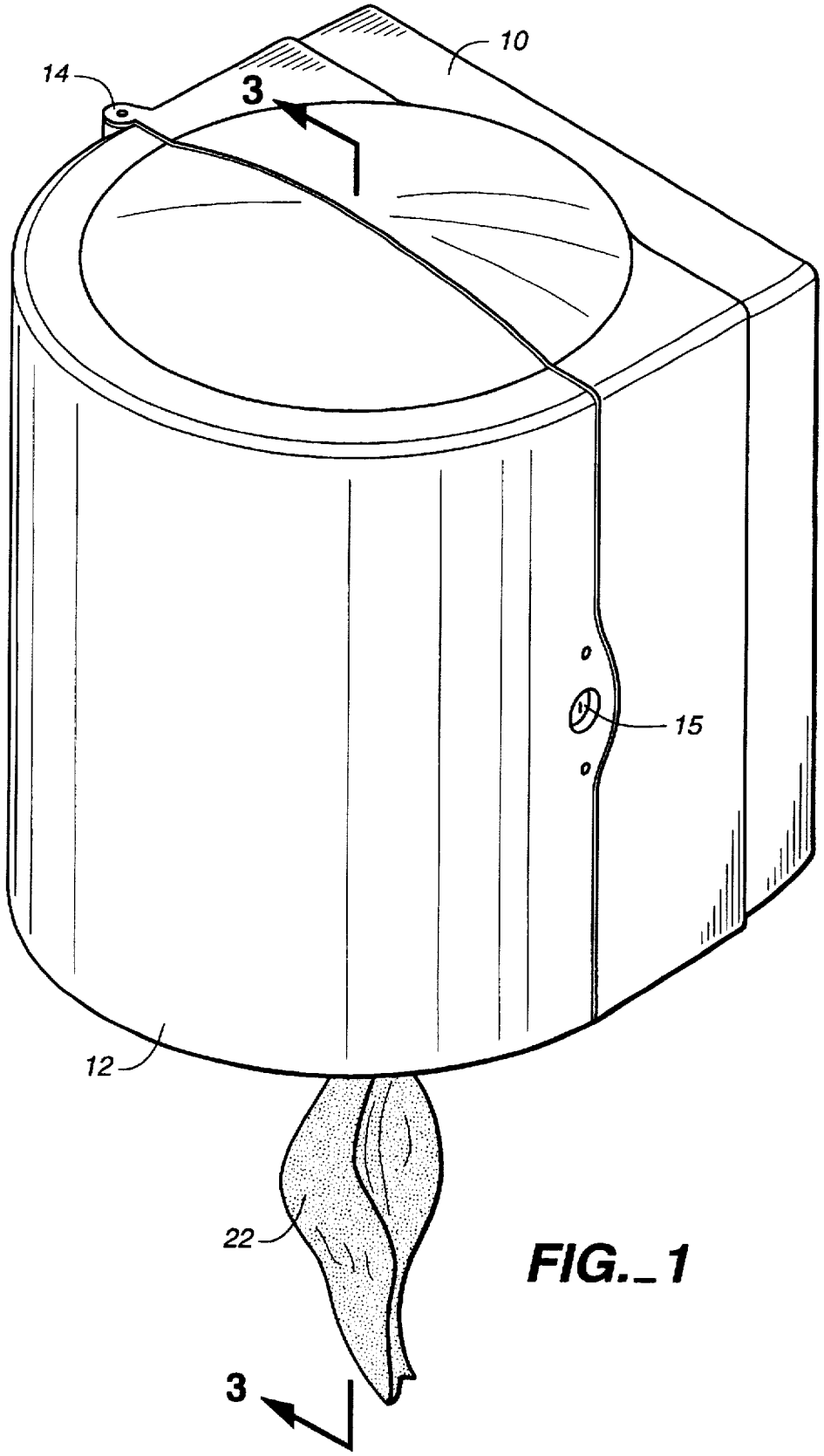
FIG. 1 is a perspective view of dispenser apparatus constructed in accordance with the teachings of the present invention with the housing members thereof in closed condition and a paper towel lead end projecting from the bottom.

Referring now to the drawings, a dispenser apparatus constructed in accordance with the teachings of the present invention includes a first housing member 10 and a second housing member 12. Second housing member 12 is pivotally mounted on the first housing member 10 by hinge 14 for movement about a substantially vertical axis, said axis being located at adjoining terminal edges of the housing members.

Figure 2:
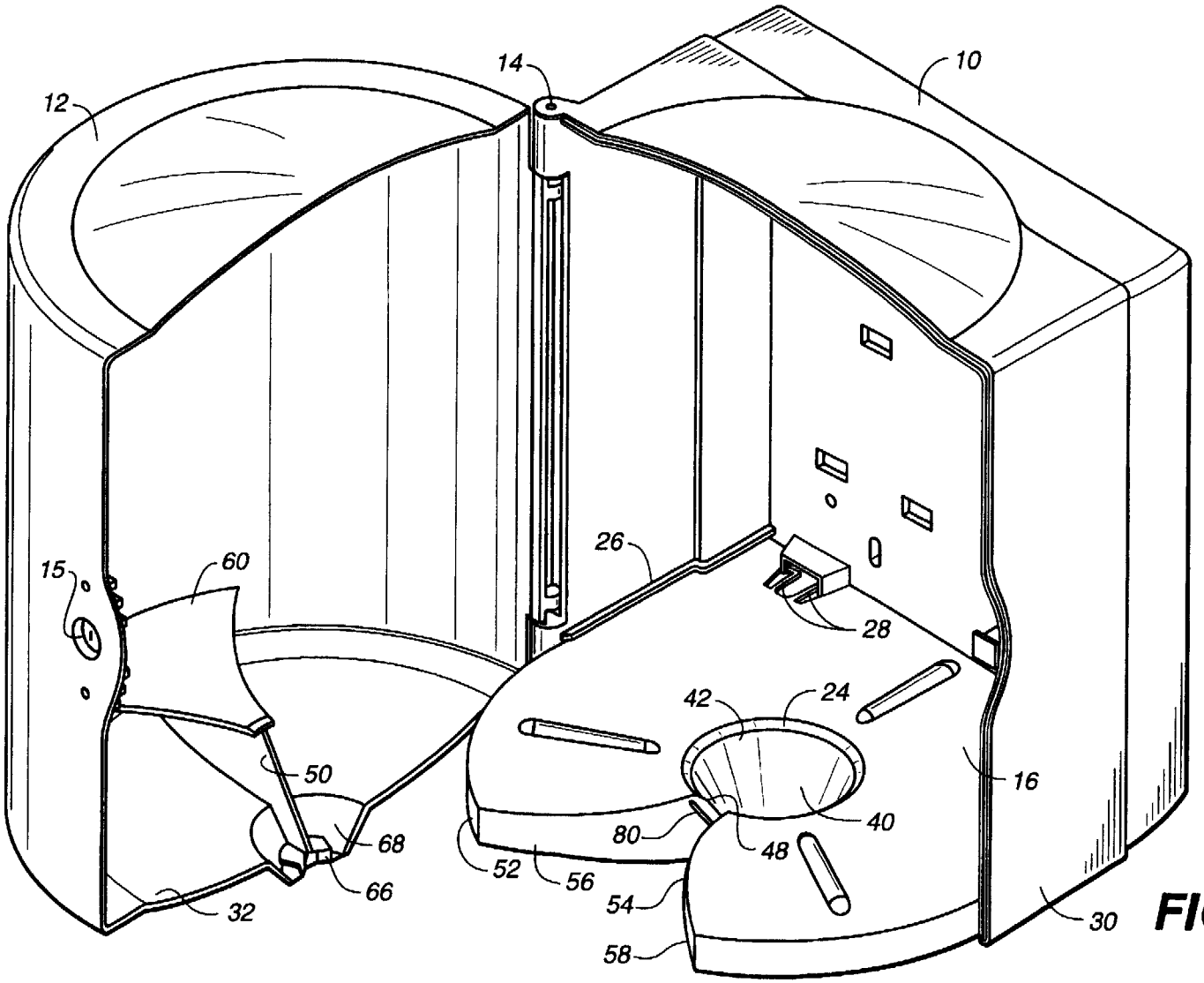
FIG. 2 is a perspective view of the apparatus in open condition and disclosing an empty interior.

The second housing member is horizontally moveable about hinge 14 between a closed position shown in FIG. 1, for example, wherein the first and second housing members define a substantially closed housing interior, and an open position, the latter being illustrated in FIG. 2, for example. First housing member 10 is for mounting on a wall or other suitable support (not shown). A suitable latch structure 15 is employed to releasably maintain the housing members closed.

Releasably attached to the first housing member is a roll product support plate 16 for supporting a coreless roll product on end. The roll product is typically a coreless paper towel comprised of a plurality of individual towels interconnected by lines of perforation. Since such towel constructions are well known, the roll towel is not shown in its entirety.

When the towel is located in the apparatus for dispensing, a lead end 22 thereof (FIG. 1) projects outwardly and downwardly from the center thereof. Support plate 16 defines a support plate opening 24 located under the center of the towel. The support plate 16 is positioned between and by support rails 26 projecting inwardly from the first housing member. Latch members 28 are utilized to releasably attach the roll product support plate to the rear wall of the first housing member. The roll product support plate is positioned above a bottom wall of the apparatus, the bottom wall being formed by bottom wall portions 30, 32 of the first and second housing members, respectively.

A dispensing member 40 is integral with and projects downwardly from the roll product support plate. Dispensing member 40 includes a downwardly converging, generally cone-shaped wall 42 defining a passageway 44 communicating with support plate opening 24 and leading from the support plate opening to a restricted outlet opening 46.

The downwardly converging, generally cone-shaped wall 42 and the support plate 16 define an elongated slot 48 extending all the way between the support plate opening and the restricted outlet opening. The support plate opening and the passageway are for accommodating the towel lead end 22 projecting outwardly from the center of the coreless towel product supported on end by the support plate. As will be seen below, the slot 48 is for facilitating insertion of the lead end into the passageway 44.

Figure 3:
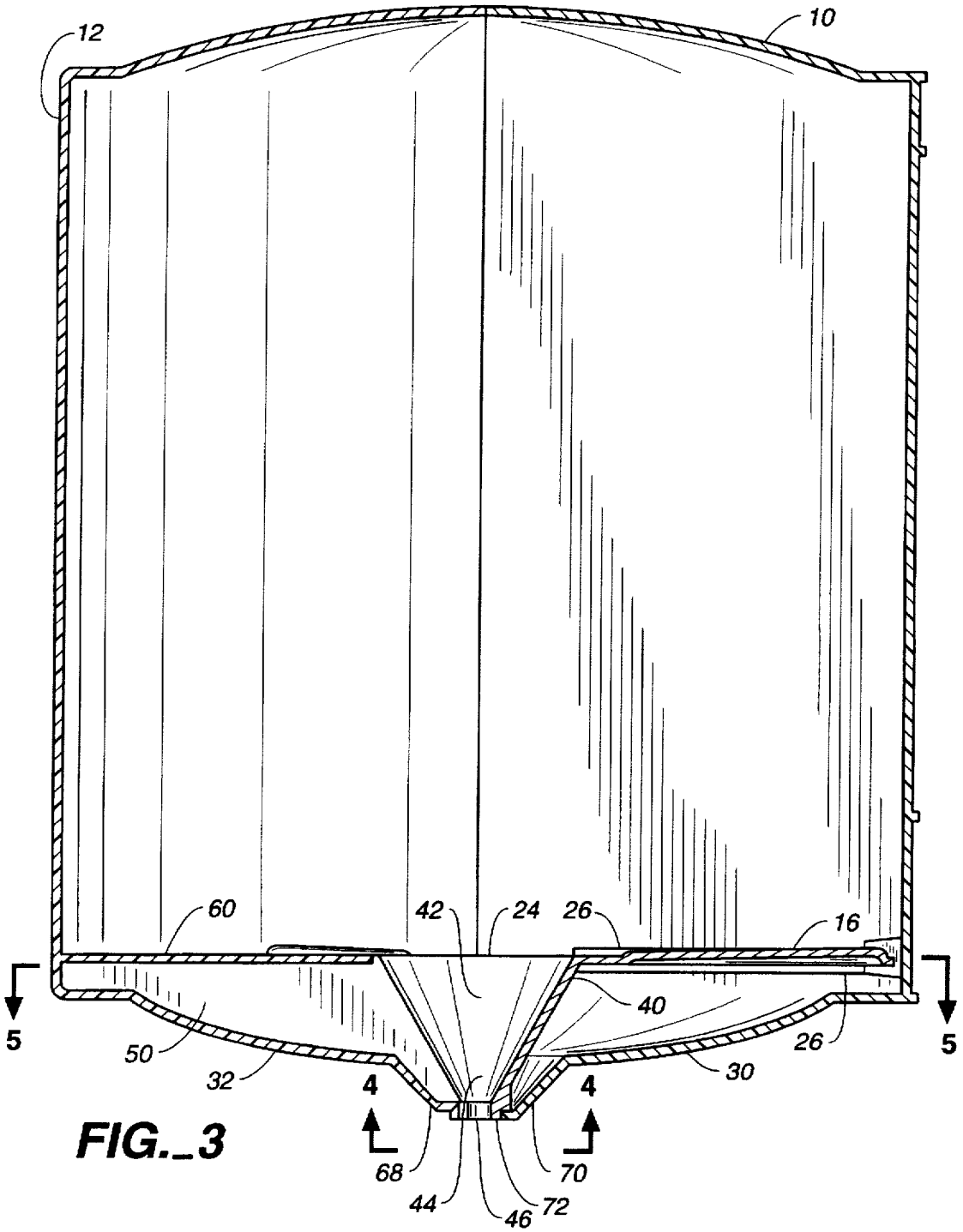
FIG. 3 is a cross-sectional view taken along the line 3—3 in FIG. 1.
Figure 5:
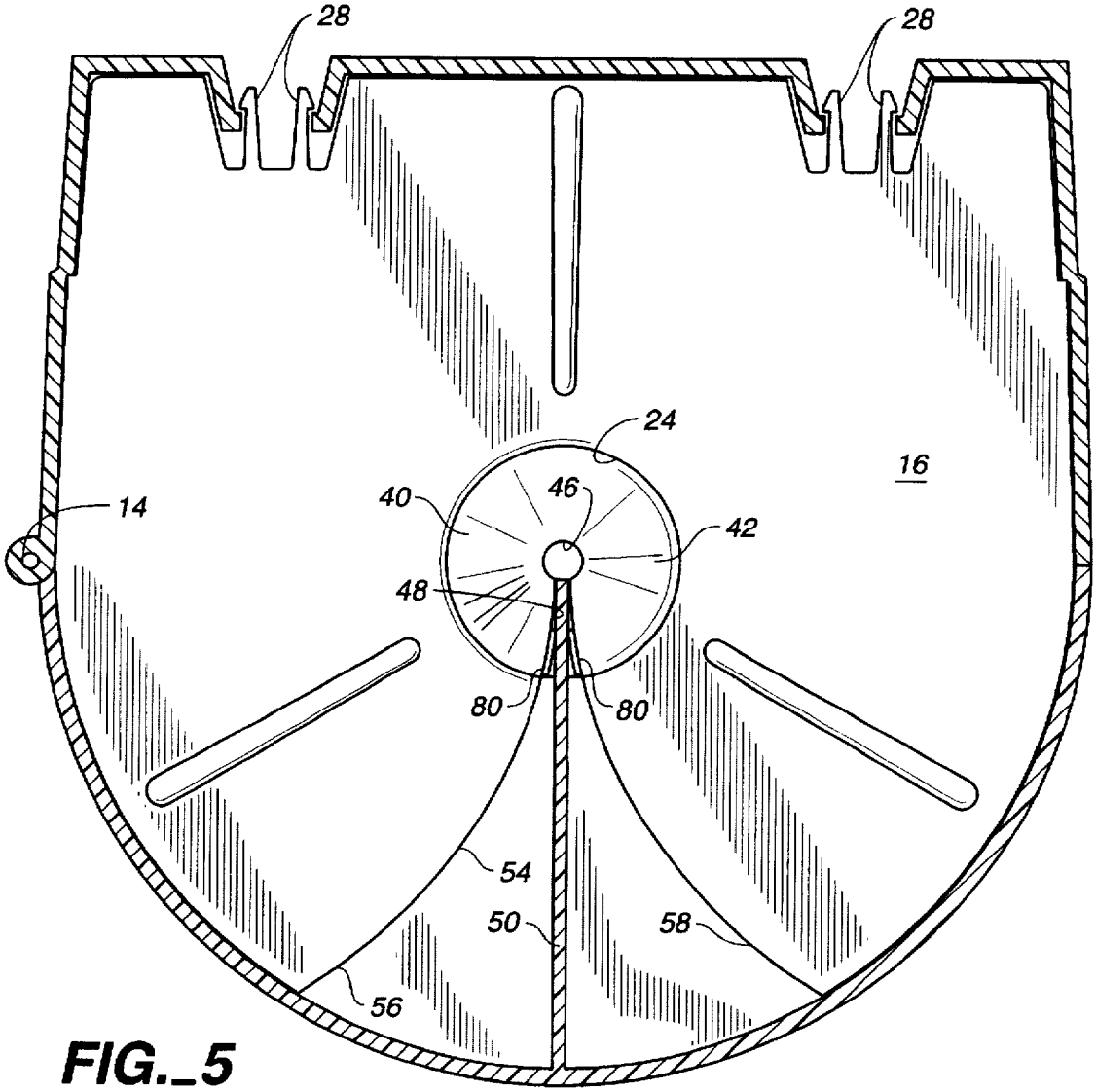
FIG. 5 is a cross-sectional view taken along line 5—5 in FIG. 3.

An elongated, relatively narrow, vertically oriented, elongated rib member 50 is connected to the second housing member. The rib member is positioned in the slot 48 and located between the support plate opening and the restricted outlet opening of dispensing member 40 when the second housing member is in closed position. See FIGS. 3 and 5. The rib member is withdrawn from the slot when the second housing member is in the open position. See FIG. 2.

It should be noted that the rib member is narrower than the slot so that the rib member is spaced from the dispensing member when positioned in the slot and spaces are defined by the opposed sides of the rib members and the dispensing member. This arrangement lessens the likelihood of toweling being pinched between the rib and dispensing member when the second housing member is moved to its closed position. Such pinching could, of course, prevent proper operation of the apparatus during dispensing.

The roll product support plate 16 has an outwardly facing support plate edge 52 spaced from the support plate opening 24. The support plate forms a gap 54 extending from support plate opening 24 to edge 52. The gap is defined by spaced curved surfaces 56, 58 which diverge away from one another in a substantially horizonal direction.

Located within the confines of second housing member 12 and connected thereto is a plate segment 60, said plate segment being disposed on top of rib member 50 and oriented in a horizontal direction. The shape and size of the plate segment 60 correspond to the shape and size of gap 54 formed in the support plate. The side edges or edge surfaces of the plate segment curve in a horizontal plane. This curved configuration permits the second housing member to be moved to closed position (as well as to be moved to open position) with the support plate curved surface 56 in close proximity with one of the curved plate segment surfaces. This adds to the stability of the structure during such movement and acts as a guide to ensure correct positioning of the rib member in the elongated slot. When the second housing member 12 is completely closed, both curved edges or edge surfaces of the plate segment are in close proximity with the curved surfaces 56, 58 of the support plate.

Figure 4:
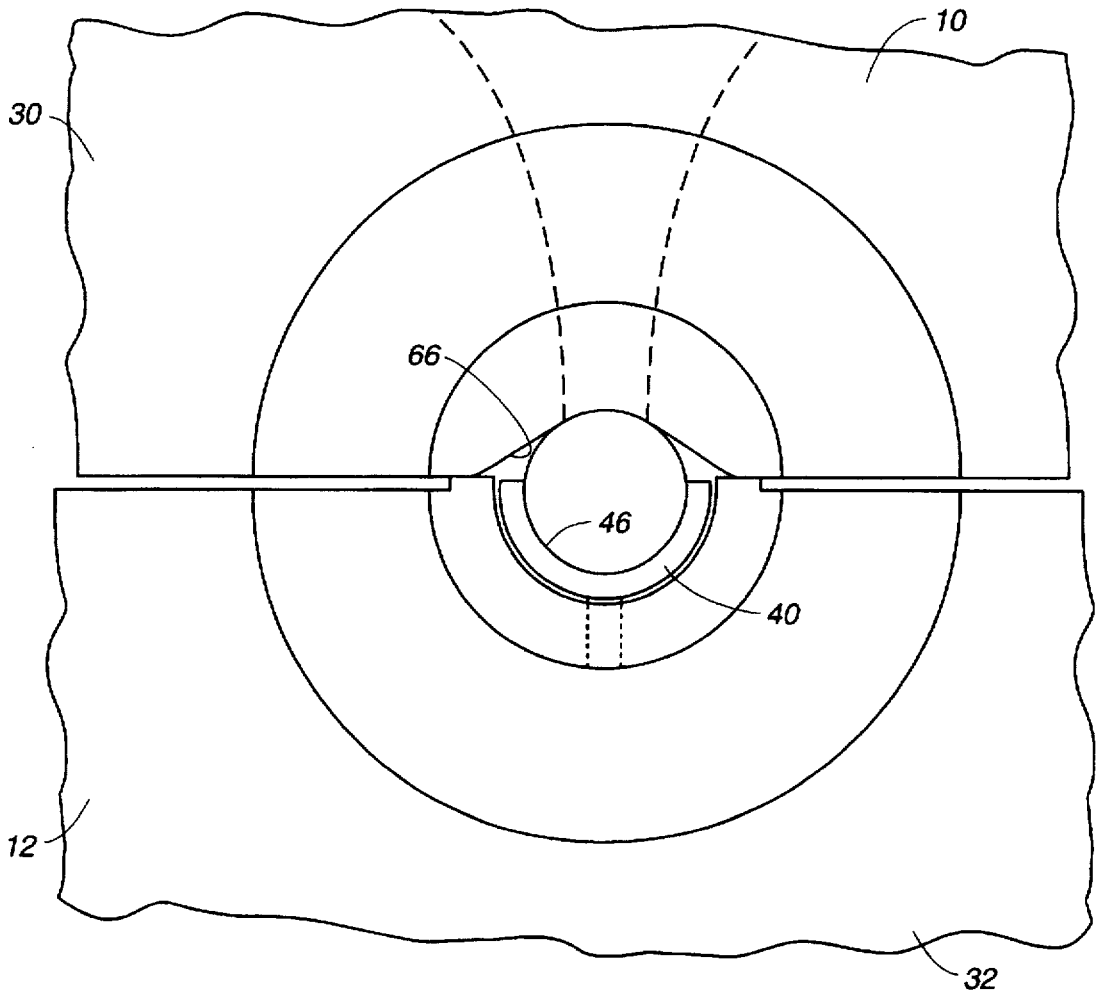
FIG. 4 is an enlarged bottom view of a portion of the apparatus designated by line 4—4 in FIG. 3.

The bottom wall comprised of bottom wall portions 30, 32 defines a bottom wall opening 66 positioned along the line of juncture formed by the bottom wall portions when the second housing member is in closed position. See FIG. 4. Each of the bottom wall portions includes a downwardly extending bottom wall member, such members being identified by reference numerals 68 and 70, combining to form structure in the general shape of a truncated cone which surrounds dispensing member 40 at the restricted outlet opening thereof. The rib member 50 extends downwardly into bottom wall member 68 so that it enters the lower end of elongated slot 48. Such an arrangement provides additional structural stability to the apparatus. An abutment member 72 is formed on dispensing member 40 and is engageable with the apparatus bottom wall to limit downward movement of the dispensing member relative to the bottom wall. The bottom wall members 68, 70 are spaced apart immediately adjacent to the bottom wall opening 66 when the second housing member is in its closed position. Such an arrangement lessens the likelihood of "pinching" of the towel lead end when the second housing member is closed.

Threading of the lead end of a towel positioned in the apparatus is readily accomplished when the second housing member 12 is in open position, the lead end simply being manually placed in the slot 48 so that it exits restricted outlet opening 46. Rib-like projections 80 projecting from the curved surfaces 56, 58 perform the function of resisting outward movement of the lead end back into the slot from passageway 44.

We claim:

1. Apparatus for dispensing individual sheets from the center of a coreless roll product comprised of a plurality of said sheets forming a wound web having a lead end projecting outwardly from said center, said apparatus comprising in combination:

a first housing member;

a second housing member pivotally mounted on said first housing member for movement about a substantially vertical pivot axis, said second housing member substantially horizontally movable between a closed position wherein said first and second housing members define a substantially closed housing interior and an open position;

a roll product support plate attached to said first housing member for supporting a coreless roll product on end and defining a support plate opening;

a dispensing member projected downwardly from said roll product support plate and including a downwardly converging, generally cone-shaped wall defining a passageway communicating with said support plate opening and leading from said support plate opening to a restricted outlet opening, said downwardly converging, generally cone-shaped wall and said support plate defining an elongated slot extending between said support plate opening and said restricted outlet opening, said support plate opening and said passageway for accommodating the lead end projecting outwardly from the center of a coreless roll product supported on end by said support plate and said slot for facilitating insertion of the lead end into said passageway; and an elongated rib member connected to said second housing member, said elongated rib member being positioned in said slot and located between said support plate opening and said restricted outlet opening when said second housing member is in said closed position and withdrawn from said slot when said second housing member is in said open position.

2. The apparatus according to claim 1 wherein said roll product support plate has a support plate edge spaced from said support plate opening, and said apparatus additionally comprising a plate segment attached to said second housing member above said elongated rib member, said roll product support plate forming a gap extending from said support plate opening to said support plate edge, and said plate segment substantially closing said gap when said second housing member is in said closed position and said plate segment being withdrawn from said gap when said second housing member is in said open position.

3. The apparatus according to claim 2 wherein said roll product support plate includes at least one curved support plate surface defining said gap and curving in a substantially horizontal direction and wherein said plate segment includes at least one curved plate segment surface curving in a substantially horizontal direction, the curves of said curved support plate surface and said curved plate segment surface being substantially the same and said curved support plate surface and said curved plate segment surface being in close proximity when said second housing member is in said closed position.

4. The apparatus according to claim 3 additionally comprising at least one projection projecting from said roll product support plate into said gap adjacent to said elongated slot for engagement by the lead end projecting outwardly from the center of a coreless roll product supported on end by said support plate within said passageway to resist outward movement of said lead end from said passageway through said gap.

5. The apparatus according to claim 4 wherein two opposed projections project from said roll product support plate into said gap adjacent to said elongated slot.

6. The apparatus according to claim 1 wherein said elongated rib member includes opposed rib member sides and wherein said elongated rib member is spaced from said dispensing member when positioned in said slot whereby spaces are defined by the opposed rib member sides and said dispensing member.

7. The apparatus according to claim 1 wherein said first and second housing members each include a bottom wall portion, said bottom wall portions being closely adjacent when said second housing member is in said closed position to form a bottom wall.

8. The apparatus according to claim 7 wherein said bottom wall is located under said roll product support plate and defines a bottom wall opening accommodating said dispensing member.

9. The apparatus according to claim 8 additionally comprising means limiting downward movement of said dispensing member relative to said bottom wall.

10. The apparatus according to claim 9 wherein said means limiting downward movement of said dispensing member relative to said bottom wall comprises an abutment member on said dispensing member engageable with said bottom wall.

11. The apparatus according to claim 8 wherein said bottom wall opening is positioned along a line of juncture formed by said bottom wall portions when said second housing member is in said closed position, each of said bottom wall portions including a downwardly extending bottom wall member, said downwardly extending bottom wall members being spaced apart immediately adjacent to said bottom wall opening when said second housing member is in said closed position.

12. The apparatus according to claim 1 wherein said roll product support plate is releasably attached to said first housing.

13. A method for loading a coreless roll product, including a plurality of individual sheets forming a wound web having a lead end projecting outwardly from the center of said coreless roll, in a dispenser comprising:

a) providing a dispenser comprising in combination:

a first housing member;

a second housing member pivotally mounted on said first housing member for movement about a substantially vertical pivot axis, said second housing member substantially horizontally movable between a closed position wherein said first and second housing members define a substantially closed housing interior and an open position;

a roll product support plate attached to said first housing member for supporting said coreless roll product on end and defining a support plate opening;

a dispensing member projected downwardly from said roll product support plate and including a downwardly converging, generally cone-shaped wall defining a passageway communicating with said support plate opening and leading from said support plate opening to a restricted outlet opening, said downwardly converging, generally cone-shaped wall and said support plate defining an elongated slot extending between said support plate opening and said restricted outlet opening, said support plate opening and said passageway for accommodating the lead end projecting outwardly from the center of said coreless roll product supported on end by said support plate and said slot for facilitating insertion of the lead end into said passageway; and an elongated rib member connected to said second housing member, said elongated rib member being positioned in said slot and located between said support plate opening and said restricted outlet opening when said second housing member is in said closed position and withdrawn from said slot when said second housing member is in said open position;

b) opening said dispenser;

c) inserting the lead end projecting outwardly from the center of said coreless roll product through said slot; and d) closing said dispenser.

14. The method according to claim 13 wherein said roll product support plate has a support plate edge spaced from said support plate opening, and said apparatus additionally comprising a plate segment attached to said second housing member above said elongated rib member, said roll product support plate forming a gap extending from said support plate opening to said support plate edge, and said plate segment substantially closing said gap when said second housing member is in said closed position and said plate segment being withdrawn from said gap when said second housing member is in said open position.

15. The method according to claim 14 wherein said roll product support plate includes at least one curved support plate surface defining said gap and curving in a substantially horizontal direction and wherein said plate segment includes at least one curved plate segment surface curving in a substantially horizontal direction, the curves of said curved support plate surface and said curved plate segment surface being substantially the same and said curved support plate surface and said curved plate segment surface being in close proximity when said second housing member is in said closed position.

16. The method according to claim 15 additionally comprising at least one projection projecting from said roll product support plate into said gap adjacent to said elongated slot for engagement by the lead end projecting outwardly from the center of a coreless roll product supported on end by said support plate within said passageway to resist outward movement of said lead end from said passageway through said gap.

17. The method according to claim 16 wherein two opposed projections project from said roll product support plate into said gap adjacent to said elongated slot.

18. The method according to claim 13 wherein said elongated rib member includes opposed rib member sides and wherein said elongated rib member is spaced from said dispensing member when positioned in said slot whereby spaces are defined by the opposed rib member sides and said dispensing member.

19. The method according to claim 13 wherein said first and second housing members each include a bottom wall portion, said bottom wall portions being closely adjacent when said second housing member is in said closed position to form a bottom wall.

20. The method according to claim 19 wherein said bottom wall is located under said roll product support plate and defines a bottom wall opening accommodating said dispensing member.

21. The method according to claim 20 additionally comprising means limiting downward movement of said dispensing member relative to said bottom wall.

22. The method according to claim 21 wherein said means limiting downward movement of said dispensing member relative to said bottom wall comprises an abutment member on said dispensing member engageable with said bottom wall.

23. The method according to claim 20 wherein said bottom wall opening is positioned along a line of juncture formed by said bottom wall portions when said second housing member is in said closed position, each of said bottom wall portions including a downwardly extending bottom wall member, said downwardly extending bottom wall members being spaced apart immediately adjacent to said bottom wall opening when said second housing member is in said closed position.

24. The method according to claim 13 wherein said roll product support plate is releasably attached to said first housing.

25. The method according to claim 13 further comprising dispensing at least one individual sheet from said loaded dispenser.

26. The method according to claim 13 further comprising removing a substantially depleted coreless roll product from said dispenser prior to inserting the lead end projecting outwardly from the center of said coreless roll product through said slot.

* * * * *